United States Patent [19]

Elliott, Jr.

[11] 4,241,922

[45] Dec. 30, 1980

[54] GOLF TRAINING AID

[76] Inventor: Denvier D. Elliott, Jr., 5127 Palmyra Ave., Las Vegas, Nev. 89102

[21] Appl. No.: 37,497

[22] Filed: May 10, 1979

Related U.S. Application Data

[63] Continuation-in-part of Ser. No. 893,960, Apr. 6, 1978, abandoned.

[51] Int. Cl.[3] ..... A63B 69/36

[52] U.S. Cl. ..... 273/189 A; 128/87 R

[58] Field of Search ..... 273/189 A, 189 R, 183 B, 273/54 B; 128/77, 87 R, 90, 165

[56] References Cited

U.S. PATENT DOCUMENTS

| | | | |
|---|---|---|---|
| D. 234,434 | 3/1975 | Trevino | 273/189 A X |
| 2,794,638 | 6/1957 | Risher et al. | 273/54 B |
| 2,924,458 | 2/1960 | Barry | 273/54 B |
| 3,048,169 | 8/1962 | Pierce | 128/90 |
| 3,117,786 | 1/1964 | Anderson | 273/54 B |
| 3,217,332 | 11/1965 | Gross | 128/77 X |
| 3,339,926 | 9/1967 | Coupar | 273/189 A X |
| 3,423,095 | 1/1969 | Cox | 273/189 A |
| 3,906,943 | 9/1975 | Arluck | 128/87 R X |

FOREIGN PATENT DOCUMENTS

| | | | |
|---|---|---|---|
| 346649 | 5/1960 | Switzerland | 128/87 R |

*Primary Examiner*—George J. Marlo
*Attorney, Agent, or Firm*—Seiler & Quirk

[57] ABSTRACT

A golf training aid for attachment to the leading arm of a golf swing has a sleeve portion which encircles the forearm and wrist, and a hand-restricting portion which prevents substantial movement of the hand relative to the forearm in the forward and sideward directions. The sleeve and hand-restricting portions are oriented to maintain the forearm and hand in a straight line during a chip or pitch shot.

4 Claims, 5 Drawing Figures

GOLF TRAINING AID

RELATIONSHIP TO OTHER APPLICATIONS

This application is a continuation-in-part of application Ser. No. 893,960, filed Apr. 6, 1978, entitled Golfing Training Aid, now abandoned.

BACKGROUND OF THE INVENTION

This invention relates to a training aid to assist a golfer in learning proper trechnique for pitch or chip shots.

One of the most difficult shots for a golfer to learn properly, and for a golf professional to teach, are pitch or chip shots executed within about 20 yards of the green. These shots are some of the most important in the game of golf, since a well-executed pitch shot will enable a golfer to get down in one putt, thereby ultimately making a very substantial difference in his score. Generally accepted teaching philosphy would indicate that these shots be executed with a short, smooth backswing, and with a firm wrist.

Because most golfers spend most of their practice time taking full swings with a variety of woods or irons, they are accustomed to taking relatively large backswings, and to breaking the wrists just prior to the moment of impact of the club head with the ball. For chip shots and pitch shots, however, breaking of the wrists proximate to impact can result in imparting an undesired spin to the ball, topping or "sculling" the ball, or striking the ground prior to the ball, all of which are detrimental to the accuracy of the shot. For an average golfer, poor chipping can easily add six to ten strokes per round of golf.

Because of the natural tendency for a golfer's wrists to break during any iron shot, teaching a contrary habit for very short shots can be quite difficult. Accordingly, it is an object of the invention to provide a golf training aid which is worn on the lower arm and wrist and which prohibits undesired motion of the hand about a wrist axis. It is a further object of the invention to provide an aid for training of certain forearm, wrist and hand muscles to facilitate the desired "muscle memory" for proper execution of pitch and chip shots. It is a still further object of the invention to provide a lightweight, easily attached and removed training aid which precludes improper hand and wrist action during a pitch or chip shot.

A number of devices for use in training golfers in proper hand and wrist action for various shots are known. For example, Coupar, U.S. Pat. No. 3,339,926, and Cox, U.S. Pat. No. 3,423,095, disclose various aids for maintaining proper wrist and arm relationship during strokes requiring a full golf swing. Trevino, U.S. Pat. No. 234,434, discloses a similar restraining device used for teaching a putting stroke. However, none of the devices of the prior art are either concerned with or useful for training a golfer to hit pitch and chip shots. None of the devices known heretofore provide sufficient limitations of movement of the hand and wrist in the necessary directions for such short iron shots.

SUMMARY OF THE INVENTION

A golf training aid for attachment to the lower forearm and wrist of the leading arm of a golf swing to substantially inhibit motion between the wrist and forearm comprises a sleeve portion substantially encircling the lower forearm and wrist, attchment means for retaining said sleeve portion in place, a hand restricting portion fully overlying the back of a golfer's hand and first knuckles to prevent motion in the direction of the forward swing about an axis transverse of the wrist, said hand restricting portion including a first sidewall overlying the second metacarpal bone of the hand precluding motion generally parallel to said axis, and a second sidewall oppositely disposed from said first sidewall to overlie the fifth metacarpal bone of the hand precluding motion thereof in a direction opposite to said first mentioned motion, said training aid having a surface extending in a substantially straight line along the entire length of the sleeve portion and the hand restricting portion.

BRIEF DESCRIPTION OF THE DRAWINGS

The invention is best understood with reference to the drawings, in which.

DETAILED DESCRIPTION OF A PREFERRED EMBODIMENT

Figure 1:
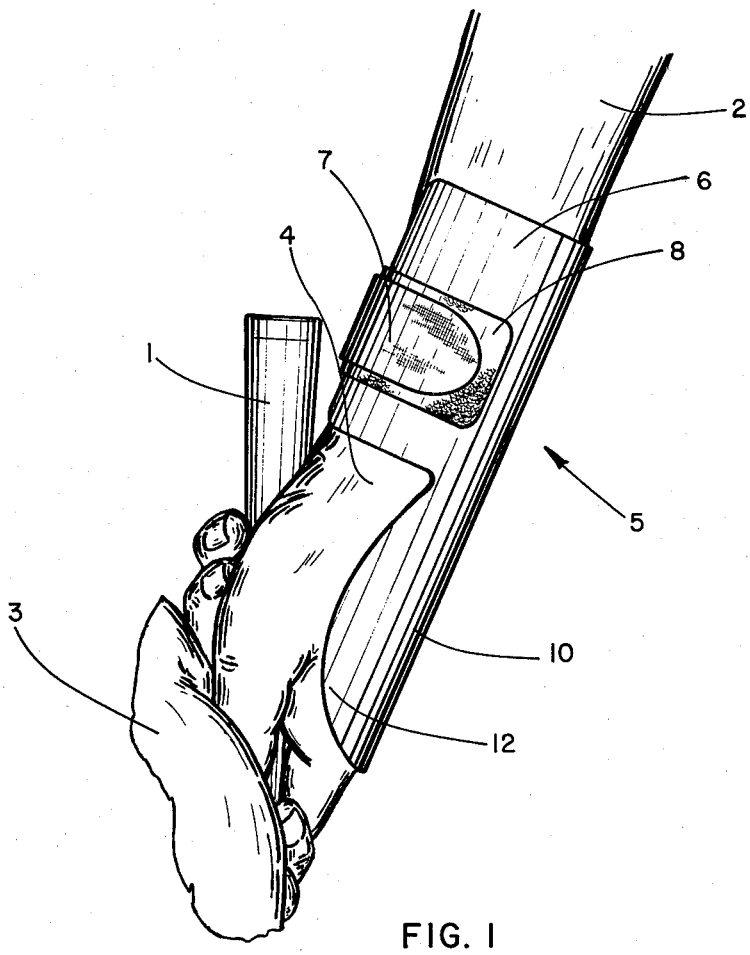
FIG. 1 is a front elevational view of the upper end of a golf club gripped by a right-handed golfer with the training aid of the invention in place on the golfer's left hand.
Figure 2:
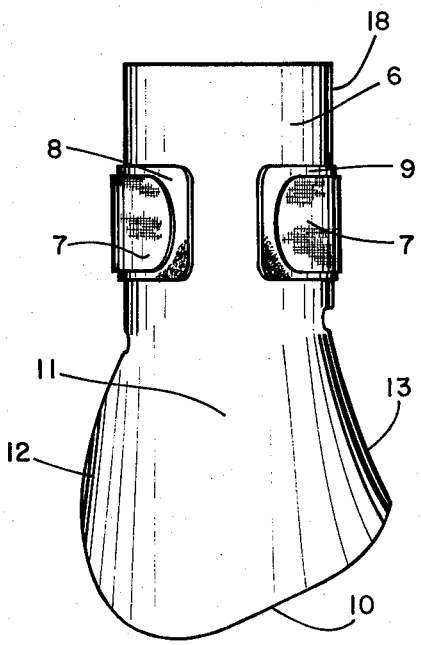
FIG. 2 is a front elevational view of the training device of the invention.

Referring to FIG. 1, a golfer gripping golf club 1 in conventional manner is wearing the training aid 5 of the invention over his left forearm 2. A portion of the right hand 3 is shown in a conventional overlapping grip.

Figure 3:
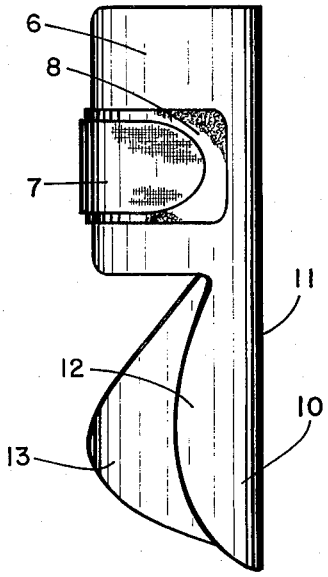
FIG. 3 is a side elevational view of the left-hand side of the device.
Figure 4:
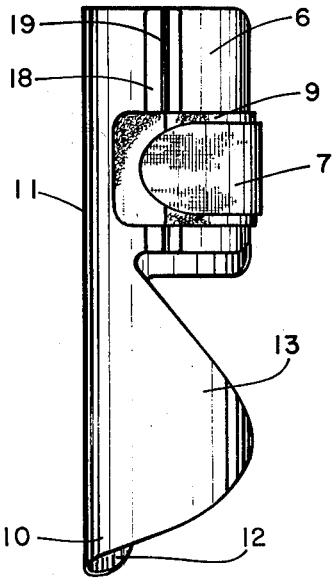
FIG. 4 is a side elevational view of the right-hand side of the device.

The training aid 5 is fabricated from a lightweight, substantially rigid plastic material formed to generally fit the outer portion of the lower arm, wrist, and back of the hand. A substantially circular sleeve portion 6 of the aid fits over the forearm and extends over the wrist, as shown in FIG. 1. A concave hand restricting portion 10 extends over the back of the hand and over the first set of knuckles (metacarpal phalangeal joints). The training aid has a forward surface 11 extending along the length of the entire training aid in a substantially straight line, as shown in FIGS. 1, 3, and 4, and as is also apparent from the end view in FIG. 5. The straight forward surface of the training aid is extremely important in precluding forward motion of the hands relative to the wrists (i.e., breaking the wrists), which is by far the most common mistake made by golfers in executing a pitch or chip shot.

Figure 5:
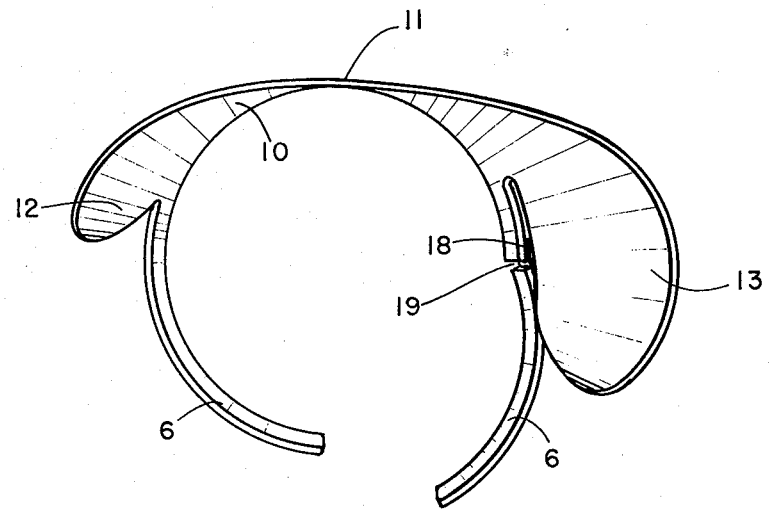
FIG. 5 is a bottom end view of the device.

The device of the invention is attached to a golfer's leading wrist by means of a hinged section which permits insertion of the forearm into the sleeve, and which is snugly fastened to the forearm by means of a strap 7. As shown in FIGS. 4 and 5, the hinged portion is fabricated by axially cutting a portion of the sleeve at 19, and attaching a thin, flexible strip of plastic along the cut, thereby permitting the rigid sections of the sleeve to pivot around the hinge. The removable strap 7 attaches to strips of material 8 and 9 extending circumferentially around a portion of the sleeve. This material has fastening means which interengage with corresponding fastening means on the under-surface of strap 7. The preferred fastening means are conventional hook and loop type fasteners, marketed commercially under the trademark "Velcro". Other conventional forms of attachment, such as a buckle, may also be used.

The training aid of the invention also includes a hand restricting portion 10 which is concave and which fits over the entire back of the golfer's forward hand to confine the hand against movement relative to the forearm in the direction of the swing. The device preferably extends entirely over the golfer's first set of knuckles. The substantially flat forward wall 11 terminates laterally in a first sidewall 12 and a second sidewall 13 as best viewed in FIG. 5. The hand restricting portion 10 is configured to overlie the back of the golfer's foward hand with sidewalls 12 and 13 curving about the second and fifth metacarpal bones, respectively, in a manner which restricts substantial movement of the hand but avoids conflict with normal gripping of a club. Accordingly, while the golfer's leading hand is free to move about the wrist rearwardly of the direction of the swing, it is precluded from substantial movement in a direction perpendicular or transverse to the direction of the swing, and is also restrained from any motion about the wrist in the direction of swing further than a line defined by a straight line along the leading portion of the forearm of the golfer. In other words, during the chipping stroke, the training aid maintains the back of the forearm and the back of the hand in a straight line. The device of the invention is not useful for, and in fact cannot be used for, a full golf swing, because the hand-restricting portion prevents normal cocking of the wrist necessary on the backswing.

Use of the device of the invention over a period of time results in certain muscular and mental training which will permit the golfer to retain a straight, rigid relationship between the forearm and wrist during a chipping or pitching stroke. Certain variations may of course be effected in the device of the invention within the scope and spirit thereof. Obviously, the aid would be constructed in mirror-image fashion for a left-handed golfer, and may be constructed in different sizes to fit men's, women's, and children's hands. In addition, the hinged feature of the sleeve may be considered optional, since the plastic material, while substantially rigid, may nonetheless be sufficiently flexible to permit expansion to insert the forearm of a golfer into the opening in the sleeve. Accordingly, the invention should be considered limited not by the foregoing description of a detailed embodiment thereof, but rather should be limited only by the following claims.

I claim:

1. A golf training aid for attachment to a golfer's lower forearm and wrist of the leading arm of a golf swing to facilitate learning proper technique for chip and pitch shots, said aid comprising a sleeve portion adapted to substantially encircle the lower forearm and wrist of the leading arm in a golf swing, attachment means for retaining said sleeve portion in place, a hand restricting portion including a substantially straight wall portion fully overlying the back of the golfer's hand to preclude hand motion in the direction of the foward swing about an axis extending transversely of the wrist, said restricting hand portion including a first side wall overlying the second metacarpal bone of the hand and thereby confining the hand against motion generally parallel to said axis, and a second sidewall oppositely disposed from said first sidewall to overlie the fifth metacarpal bone of the hand and thereby confine the hand against motion in a direction opposite to the first mentioned motion, the length of said first and second sidewalls being such as to terminate short of the golfer's palm so as to avoid conflict with normal gripping of the club, said training aid having a surface extending in a substantially straight line along the entire length of the sleeve portion and the hand restricting portion, and said training aid having an overall length such that when properly positioned on the golfer's wrist, the device extends from above the wrist over the first set of knuckles.

2. The golf training aid of claim 1 wherein the attachment means comprises a first fastening member attached to the exterior surface of the sleeve, a second fastening member comprising strap means, each of said fastening members carrying interengaging fastening means.

3. The training aid of claim 2 wherein the interengaging fastening means are hook and loop type fastening means.

4. The training aid of claim 1 wherein the sleeve also has an axially hinged portion to permit access of a golfer's forearm into the sleeve.

* * * * *